US008248202B2

(12) United States Patent
Brackhan et al.

(10) Patent No.: US 8,248,202 B2
(45) Date of Patent: Aug. 21, 2012

(54) METAL STRIP RESISTOR FOR MITIGATING EFFECTS OF THERMAL EMF

(75) Inventors: Doug Brackhan, Columbus, NE (US); Clark L. Smith, Columbus, NE (US); Thomas L. Veik, Columbus, NE (US)

(73) Assignee: Vishay Dale Electronics, Inc., Columbus, NE (US)

( * ) Notice: Subject to any disclaimer, the term of this patent is extended or adjusted under 35 U.S.C. 154(b) by 306 days.

(21) Appl. No.: 12/536,792

(22) Filed: Aug. 6, 2009

(65) Prior Publication Data

US 2010/0237982 A1 Sep. 23, 2010

Related U.S. Application Data

(60) Provisional application No. 61/169,377, filed on Apr. 15, 2009, provisional application No. 61/161,636, filed on Mar. 19, 2009.

(51) Int. Cl.
*H01C 1/012* (2006.01)

(52) U.S. Cl. ..... 338/308; 338/329; 338/210; 338/330

(58) Field of Classification Search ..... 338/329, 338/210, 212, 330, 207, 333, 334
See application file for complete search history.

(56) References Cited

U.S. PATENT DOCUMENTS

| | | | | |
|---|---|---|---|---|
| 3,788,721 | A * | 1/1974 | Vause | 445/27 |
| 4,203,197 | A * | 5/1980 | Crandell | 29/611 |
| 4,937,551 | A * | 6/1990 | Plasko | 338/22 R |
| 5,519,191 | A * | 5/1996 | Ketcham et al. | 219/552 |
| 5,604,477 | A | 2/1997 | Rainer et al. | |
| 5,999,085 | A | 12/1999 | Szwarc et al. | |
| 6,148,502 | A | 11/2000 | Gerber et al. | |
| 6,181,234 | B1 | 1/2001 | Szwarc et al. | |
| 6,401,329 | B1 | 6/2002 | Smejkal et al. | |
| 6,794,614 | B2 * | 9/2004 | Taniguchi et al. | 219/270 |
| 6,794,980 | B2 * | 9/2004 | Chu et al. | 338/22 R |
| 7,102,484 | B2 | 9/2006 | Schneekloth et al. | |
| 7,190,252 | B2 | 3/2007 | Smith et al. | |
| 2002/0093417 | A1 | 7/2002 | Gross | |

FOREIGN PATENT DOCUMENTS

| | | |
|---|---|---|
| DE | 102004051472 | 6/2005 |
| WO | 2006093506 | 9/2006 |

* cited by examiner

*Primary Examiner* — Kyung Lee
(74) *Attorney, Agent, or Firm* — Volpe and Koenig, P.C.

(57) ABSTRACT

A metal strip resistor includes a resistor body having a resistive element formed from a strip of an electrically resistive metal material and a first termination electrically connected to the resistive element to form a first junction and a second termination electrically connected to the resistive element to form a second junction, the first termination and the second termination formed from strips of electrically conductive metal material. The resistive element, the first termination, and the second termination being arranged mitigate thermally induced voltages between the first junction and the second junction.

30 Claims, 6 Drawing Sheets

METAL STRIP RESISTOR FOR MITIGATING EFFECTS OF THERMAL EMF

CROSS REFERENCE TO RELATED APPLICATIONS

This application claims the benefit of U.S. Provisional Application Ser. No. 61/161,636 filed on Mar. 19, 2009 and U.S. Provisional Application Ser. No. 61/169,377 filed on Apr. 15, 2009, both of which are incorporated by reference as if fully set forth.

FIELD OF THE INVENTION

The present invention relates to resistors. More specifically, the present invention relates to metal strip resistors configured to assist in mitigating the effects of thermal EMF.

BACKGROUND OF THE INVENTION

Thermal electromotive force (EMF) is a voltage that is generated when two dissimilar metals are joined together. When there are two of these junctions that are of opposite polarity and the temperature of the junctions are equal, there is no net voltage. When one of the junctions is at a different temperature than the other, a net voltage difference can be detected. A resistor may have a metal resistive element connected between copper terminals, thereby providing two junctions and making the resistor susceptible to adverse effects of thermal EMF.

Resistors of this construction are often used to sense current by measuring the voltage drop across the resistor. In cases where the current is low, the signal voltage generated across the resistor is also very small and any voltage caused by thermal EMF can cause a significant measurement error.

One prior art approach to addressing this problem has been to change the metal alloy used for the resistive element to one with a lower thermal EMF. In some cases this presents other challenges such as increased cost, an increase in bulk resistivity that creates a resistor geometry that is costly to manufacture, or sacrifices other electrical characteristics such as TCR (temperature coefficient of resistance).

Another prior art approach has been to add an ASIC (application specific integrated circuit) that is programmed to compensate for the offset voltage created by the thermally induced EMF. Such an approach adds material cost, complexity to the assembly, and manufacturing cost in terms of assembly steps and equipment.

What is needed is to provide a resistor that mitigates the effects of thermal EMF while not imposing constraints on the type of metal resistance alloy used.

SUMMARY OF THE INVENTION

According to one embodiment a metal strip resistor is provided. The metal strip resistor includes a resistor body having at least one resistive element formed from a strip of a resistive metal material, (such as Evanohm, Manganin, or others), and a first termination electrically connected to the resistive element to form a first junction and a second termination electrically connected to the resistive element to form a second junction; the first termination and the second termination being formed from strips of highly electrically conductive metal material, such as copper or others, with high electrical conductivity. Prior art metal strip resistors are described in U.S. Pat. No. 5,604,477 (Rainer et al.). The resistive element, the first termination, and the second termination are arranged to assist in mitigating effects of thermally induced voltages between the first junction and the second junction. The resistor body may include a fold between a first portion of the resistor body and a second portion of the resistor body. A thermoconductive and electrically non-conductive material may be used to thermally connect the first portion of the resistor body to the second portion of the resistor body and assist in reducing the temperature differential between the first junction and the second junction to thereby mitigate the effects of the thermally induced voltages between the first junction and the second junction.

According to another embodiment, a metal strip resistor is provided. The metal strip resistor includes a resistor body having a resistive element formed from a strip of a resistive metal material and a first termination joined to the resistive element to form a first junction and a second termination joined to the resistive element to form a second junction; the first termination and the second termination being formed from strips of highly electrically conductive metal material. The resistor body is folded onto itself and mating surfaces are bonded with a thermally conductive and electrically non-conductive adhesive to thereby equalize the temperature between the two sides of the resistor body thus mitigating effects of thermally induced voltages between the first junction and the second junction.

According to another embodiment, a metal strip resistor includes a resistor body having a resistive element formed from a strip of a resistive metal material and a first termination joined to the resistive element to form a first junction and a second termination joined to the resistive element to form a second junction; the first termination and the second termination being formed from strips of highly electrically conductive metal material. The resistive element, the first termination, and the second termination are arranged to provide a first temperature gradient along a length of the first junction and a second temperature gradient along a length of the second junction such that the temperatures at any two adjacent points on opposite junctions are substantially equal.

According to another embodiment, a method of manufacturing a metal strip resistor includes joining a resistive metal material with an electrically conductive material to form a resistor body with a plurality of junctions between the resistive metal material and the electrically conductive material, folding the resistor body, and bonding the resistor body on one side of the fold to the resistor body on an opposite side of the fold with a thermoconductive and electrically non-conductive adhesive to thereby form a metal strip resistor configured for mitigating effects of thermally induced voltages.

DETAILED DESCRIPTION

The embodiments disclosed herein provide a resistor for mitigating effects of thermal electromotive force (EMF). This allows the use of any number of types of metal resistance alloy regardless of thermal EMF and negates any termination to termination temperature differential. The embodiments disclosed herein achieve desirable results by using appropriate resistor geometries, metal forming, and/or heat transfer materials.

Note that, rather than change a resistor's resistive element material and/or termination material, or add compensation circuitry to offset the thermal EMF of a specific set of resistor metal alloys, the embodiments disclosed herein provide for using a geometry that brings both metallic junctions to the same temperature. In overcoming the problem in this way the embodiments disclosed herein function regardless of the metal alloys used and their specific thermal EMF characteristics. Thus, the embodiments disclosed herein are not limited to particular types of materials and materials may be selected to optimize other electrical characteristics such as TCR, resistance, or stability without concern for the thermal EMF. This is a significant advantage.

Figure 1:
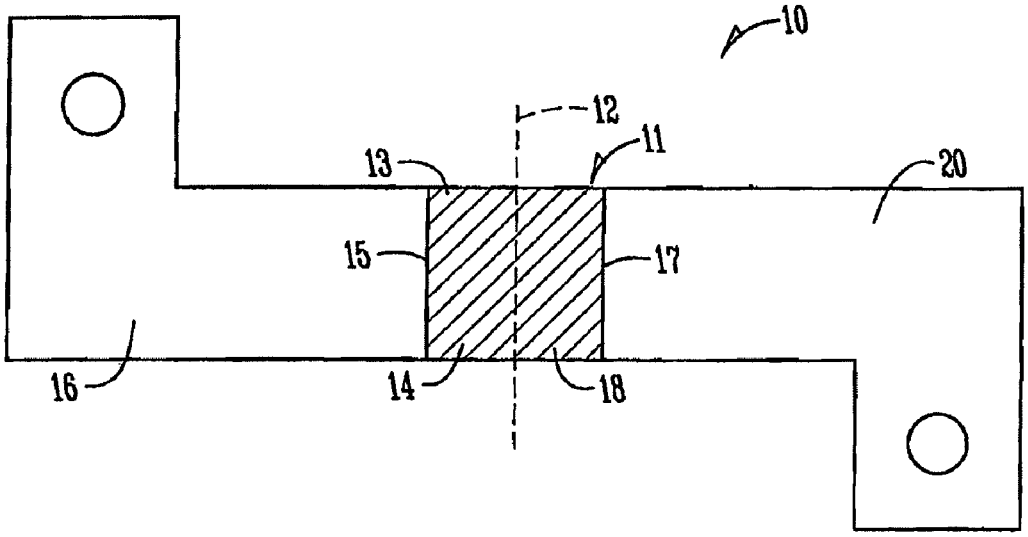
FIG. 1 illustrates a metal strip resistor prior to folding.

FIG. 1 illustrates a metal strip resistor 10 with a resistor body 11 prior to folding. The resistor body 11 has a first termination 16 and a second termination 20. The resistor body 11 includes at least one resistive element 13. The first termination 16 and the second termination 20 comprise metal strips. The resistive element 13 also comprises a metal strip of a different alloy than the termination metal. The strips are joined to provide for electrical and mechanical connections between the first termination 16 the second termination 20 and the resistive element 13. A first junction 15 is provided where the first termination 16 is joined to the resistive element 13 and a second junction 17 is provided where the second termination 20 is joined to the resistive element 13.

A fold line 12 is shown at the midpoint which is substantially equidistant between each end of the resistor body 11 and which extends through a mid point of the resistive element 13 such that a first resistive element portion 14 and a second resistive element portion 18 of the resistive element 13 are on opposite sides of the fold line 12, and such that the first termination 16 and the second termination 20 are on opposite sides of the fold line 12 and the first junction 15 and the second junction 17 are on opposite sides of the fold line 12. The resistor body 11 is subsequently folded on a line 12 which is substantially equidistant from each end of the resistor body 11. It is understood that the fold line can be located at various locations along the resistor body other than the midpoint.

Figure 3:
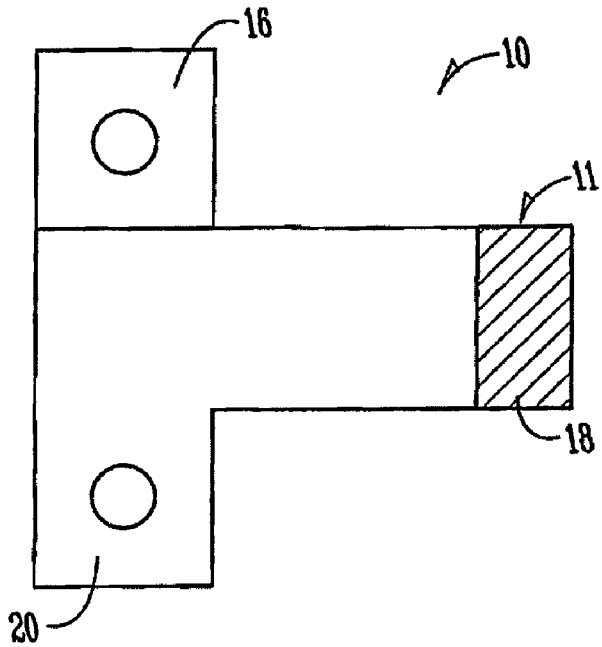
FIG. 3 illustrates the metal strip resistor of FIG. 1 after folding.
Figure 5:
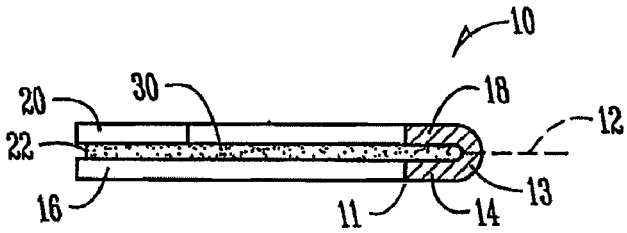
FIG. 5 is a cross sectional view of the metal strip resistor of FIG. 3.

Prior to folding, one half of what will be the inside of the folded resistor is coated with a material that has good thermal conductivity yet is not electrically conductive (thermally conductive material). The thermally conductive material can also include an adhesive that will bond the two halves of the resistor body together. FIG. 3 and FIG. 5 illustrate the resistor after folding and bonding. The resistor body is folded in half onto itself. As shown in FIG. 5, there is a gap 22 between the halves. The gap 22 may have a size in the range of 0.001 inch (0.0254 mm) to 0.005 inch (0.127 mm), although the gap may be larger or smaller. The gap 22 is filled with a thermally conductive material or adhesive 30 such as a material which includes an elastomer and a thermally conductive filler. Other thermally conductive materials could be used to achieve the desired objectives of bonding and thermal transfer from one half to the other while electrically insulating one half from the other.

By thermally connecting each half of the resistor 10 in this manner the temperature of each of the two copper-to-resistive alloy junctions are held at equal temperatures thus negating any net voltages from the thermal EMF of the junctions. Thus, the thermally conductive material 30 allows heat to be transferred between opposite sides of the resistor so that the first junction and the second junction are held at substantially equal temperatures to thereby mitigate effects of thermal EMF.

Figure 2:
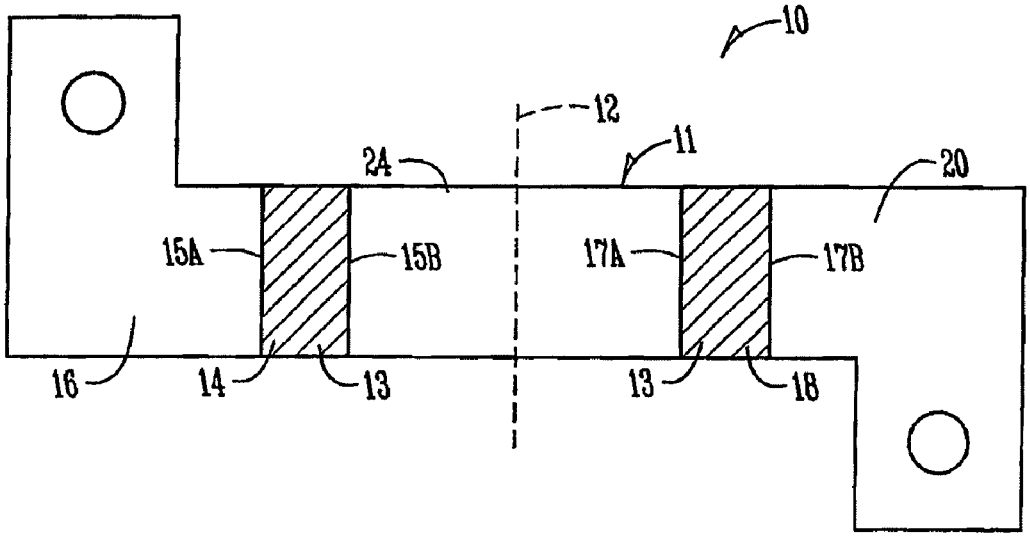
FIG. 2 illustrates a metal strip resistor prior to folding with a dual resistive element.
Figure 4:
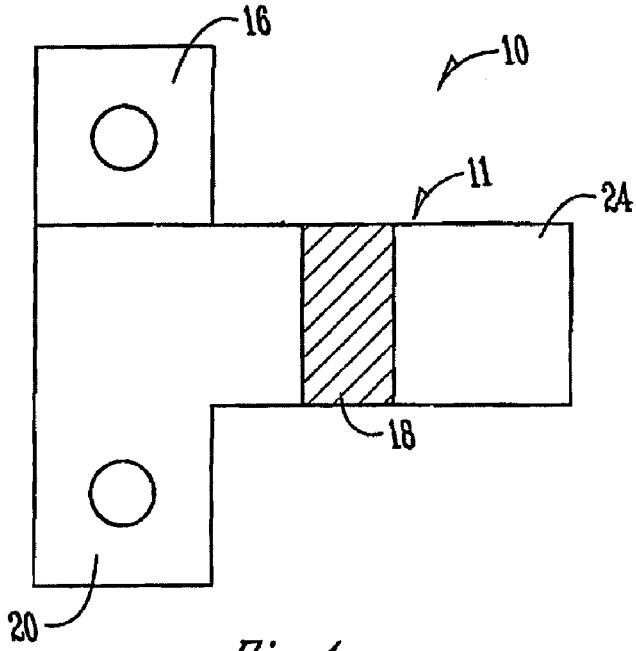
FIG. 4 illustrates the metal strip resistor of FIG. 2 after folding.
Figure 6:
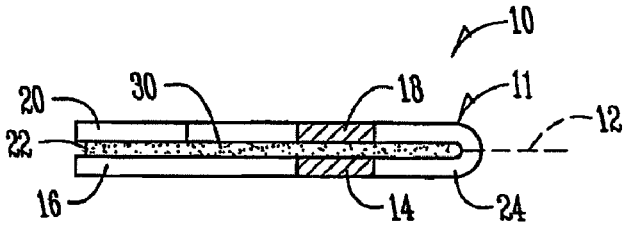
FIG. 6 is a cross sectional view of the metal strip resistor of FIG. 4.

Another embodiment is shown in FIGS. 2, 4 and 6. The resistor of FIGS. 2, 4 and 6 is the same as the resistor of FIGS. 1, 3 and 5 except that the resistive element 13 is a dual resistive element such that the first portion 14 is separated from the second portion 18 by a highly electrically conductive metal material 24. Note that in FIG. 2 there are junctions 15A, 15B on opposite sides of the first portion 14 of the resistive element 13 and there are junctions 17A, 17B on opposite sides of the second portion 18 of the resistive element 13. As best shown in FIG. 6, the dual resistive element allows for the conductive material 24 to be in the center of the folding line 12 so that mechanical stress is not induced into the resistive element 13. This configuration assists in preventing possible resistance problems which may occur if the fold line is through the resistive element. Although this configuration has four junctions 15A, 15B, 17A, 17B, instead of two, there are opposite junctions at each of the two possible temperatures. Thus, this configuration still results in mitigation of thermal EMF.

Figure 10A:
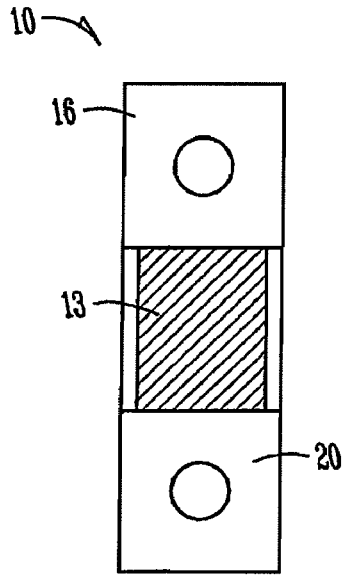
FIG. 10A-10D illustrates another metal strip resistor for mitigating effects of thermally induced voltages.
Figure 10C:
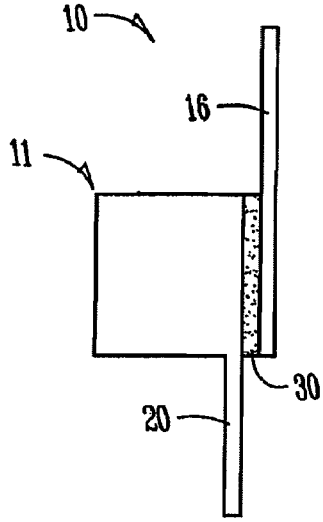
Figure 10B:
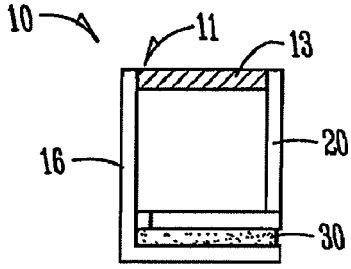
Figure 10D:
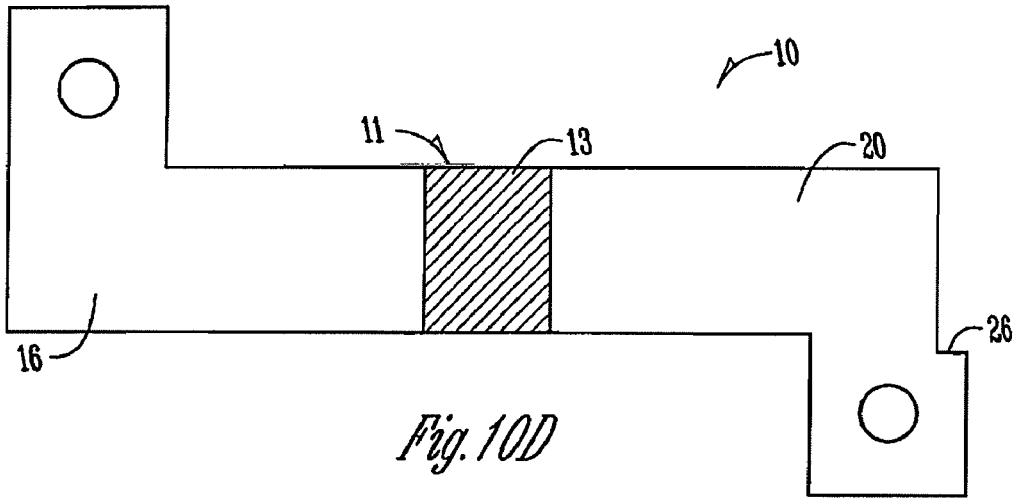
Figure 11A:
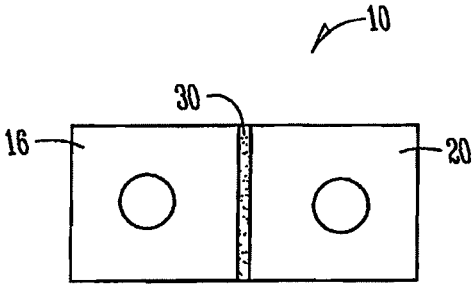
FIG. 11A-11D illustrates another metal strip resistor for mitigating effects of thermally induced voltages.
Figure 11B:
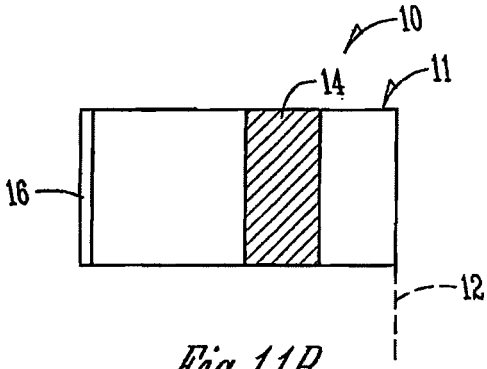
Figure 11C:
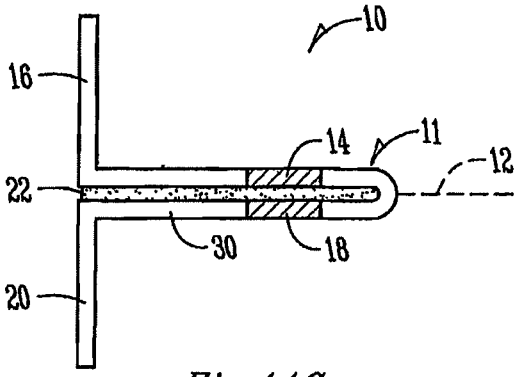
Figure 11D:
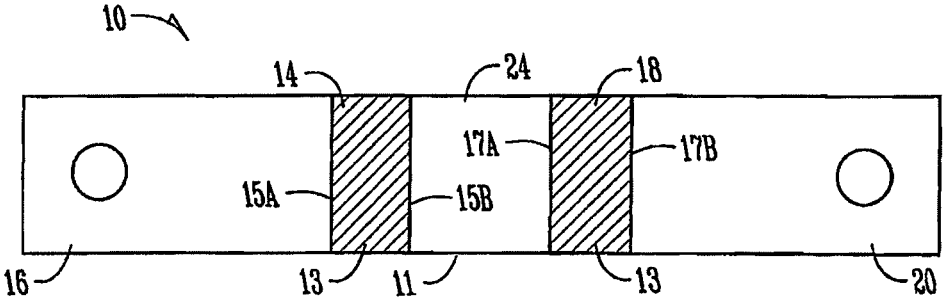

FIGS. 10A-10D illustrate another embodiment similar to that shown in FIG. 1. FIG. 10D illustrates the resistor body 11 prior to folding. Note that the geometry of the unfolded resistor body 11 is similar to the shape in FIG. 1, except that the second termination has a notch 26 in its outer edge to assist in folding into the configuration best shown in FIG. 10B.

FIGS. 11A-11D illustrate another embodiment of a resistor shows a resistor element which uses less welded strip by eliminating the terminal protrusions yet uses the same method of forming and bonding the metal junctions to prevent any junction temperature differentials.

Figure 7:
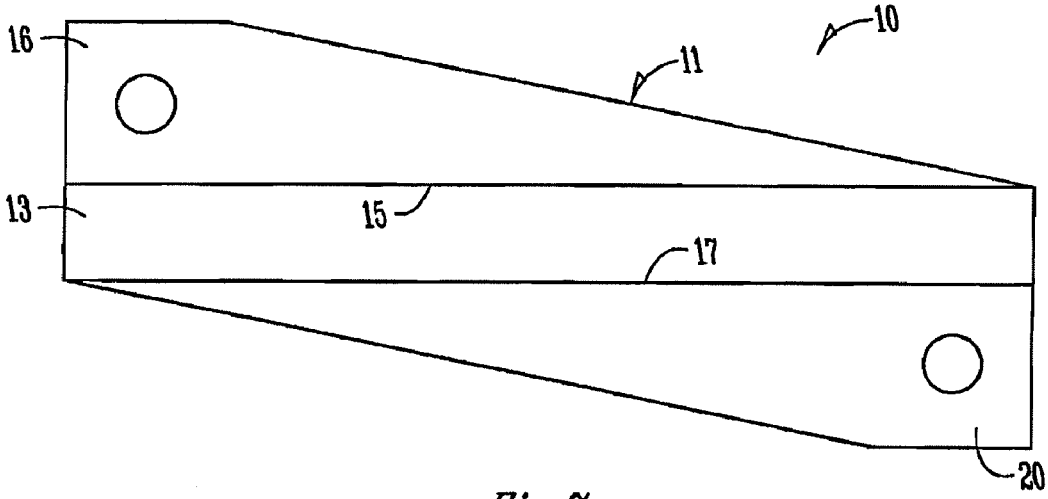
FIG. 7 illustrates a resistor with a geometry for mitigating effects of thermally induced voltages by maintaining an equal temperature gradient along each junction thus equalizing the temperature differential across the resistive element at any two adjacent points on opposite junctions.
Figure 8:
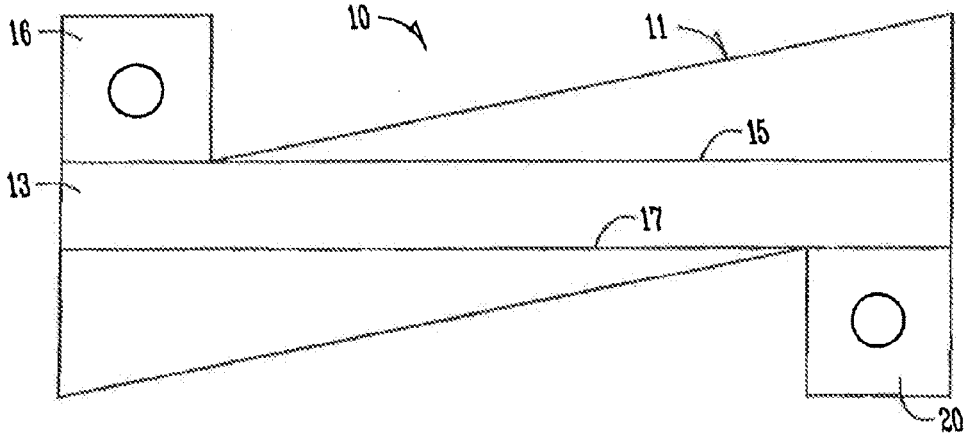
FIG. 8 illustrates another resistor with a geometry for mitigating effects of thermally induced voltages by maintaining an equal temperature gradient along each junction thus equalizing the temperature differential across the resistive element at any two adjacent points on opposite junctions.
Figure 9:
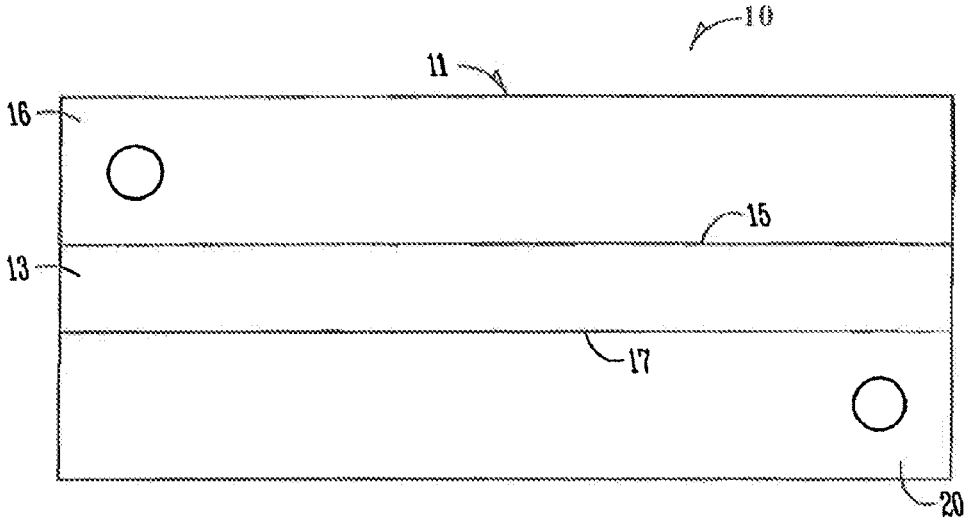
FIG. 9 illustrates another resistor with a geometry for mitigating effects of thermally induced voltages by maintaining an equal temperature gradient along each junction thus equalizing the temperature differential across the resistive element at any two adjacent points on opposite junctions.

FIG. 7, FIG. 8 and FIG. 9 show other examples of resistor geometries that provide for mitigating effects of thermal EMF associated with junctions, but without using folding. Each is of the metal strip resistor construction. Each of the copper (or other conductor)-to-resistive alloy junctions in any of these designs may have a temperature gradient along the length of each junction caused by any possible temperature differential between the two terminals. As shown in FIGS. 7 and 8, the resistor body 11 can include electrically conductive portions that are generally tapered or triangular in shape. Since the temperature gradient along the length of each junction is the same regardless of which side of the resistive element, the temperature at any two adjacent points on opposite junctions is substantially equal, and each junction is of an opposite polarity, thus thermally induced voltages are equal and opposite cancelling each other out. Note that various configurations are contemplated for mitigating thermal EMF in this manner.

Therefore, a metal strip resistor for mitigating the effects of thermal EMF has been disclosed. The embodiments disclosed herein provide a resistor for mitigating effects of thermal EMF. The embodiments disclosed herein allow the use of any number of types of metal resistance alloy regardless of thermal EMF and negates any terminal to terminal temperature differential. The embodiments disclosed herein achieve desirable results by using appropriate resistor geometries, metal forming, and/or heat transfer materials. The present invention contemplates numerous variations, options, and alternatives including variations in the geometry used, the types of materials used, and others.

What is claimed is:

1. A resistor comprising:

a first termination and a second termination;

a body having at least one resistive element, the body having a first end coupled to the first termination to form a first junction and a second end coupled to the second termination to form a second junction;

wherein the body is folded onto itself defining a gap, the first termination and second termination being disposed on opposite sides of the gap; and a thermally conductive material disposed in at least a portion of the gap.

2. The resistor of claim 1 wherein the thermally conductive material thermally connects the first and second junction.

3. The resistor of claim 1 wherein the body has a single resistive element.

4. The resistor of claim 3 wherein the body is folded through the resistive element wherein the resistive element has a first resistive element portion disposed on one side of the gap and a second resistive element portion disposed on an opposite side of the gap.

5. The resistor of claim 4 wherein the gap is disposed between the first resistive element portion and the second resistive element portion, wherein the thermally conductive material thermally connects the first resistive element portion and the second resistive element portion.

6. The resistor of claim 1 wherein the body has a plurality of resistive elements.

7. The resistor of claim 1 wherein the body has first and second resistive elements.

8. The resistor of claim 7 wherein the body is folded through a point located between the first and second resistive element wherein the first resistive element is disposed on one side of the gap and the second resistive element is disposed on an opposite side of the gap, wherein the thermally conductive material thermally connects the first resistive element and the second resistive element.

9. The resistor of claim 1 wherein the thermally conductive material further comprises an adhesive.

10. The resistor of claim 1 wherein the thermally conductive material is electrically non-conductive.

11. The resistor of claim 1 wherein the first termination and the second termination are comprised of strips of electrically conductive metal material.

12. The resistor of claim 1 wherein the first termination and the second termination are comprised of copper.

13. The resistor of claim 1 wherein the body is folded onto itself and bonded with a thermally conductive adhesive thereby mitigating thermally induced voltages between the first junction and the second junction.

14. The resistor of claim 1 wherein the body is folded at its midpoint.

15. A method of manufacturing a resistor, comprising:

joining a first end of a body to a first termination forming a first junction and joining a second end of the body to a second termination forming a second junction, wherein the body includes at least one resistive element;

folding the body onto itself, forming a gap, the first termination and second termination being disposed on opposite sides of the gap; and applying a thermally conductive material in at least a portion of the gap.

16. The method of claim 15 wherein the thermally conductive material thermally connects the first and second junction.

17. The method of claim 15 wherein the body has a single resistive element.

18. The method of claim 15 wherein the body is folded through the resistive element wherein the resistive element has a first resistive element portion disposed on one side of the gap and a second resistive element portion disposed on an opposite side of the gap.

19. The method of claim 18 wherein the gap is disposed between the first resistive element portion and the second resistive element portion, wherein the thermally conductive material thermally connects the first resistive element portion and the second resistive element portion.

20. The method of claim 15 wherein the body has a plurality of resistive elements.

21. The method of claim 15 wherein the body has first and second resistive elements.

22. The method of claim 21 wherein the body is folded through a point located between the first and second resistive element wherein the first resistive element is disposed on one side of the gap and the second resistive element is disposed on an opposite side of the gap, wherein the thermally conductive material thermally connects the first resistive element and the second resistive element.

23. The method of claim 15 wherein the thermally conductive material further comprises an adhesive.

24. The method of claim 15 wherein the thermally conductive material is electrically non-conductive.

25. The method of claim 15 wherein the first termination and the second termination are comprised of strips of electrically conductive metal material.

26. The method of claim 15 wherein the first termination and the second termination are comprised of copper.

27. The method of claim 15 wherein the body is folded onto itself and bonded with a thermally conductive adhesive thereby mitigating thermally induced voltages between the first junction and the second junction.

28. The method of claim 15 wherein the body is folded at its midpoint.

29. A resistor comprising:

a first termination and a second termination;

a body having at least one resistive element, the body having a first end coupled to the first termination to form a first junction having a length and a second end coupled to the second termination to form a second junction having the same length;

wherein the resistive element, the first termination, and the second termination are arranged to have a temperature gradient along the length of each junction, mitigating thermally induced voltages between the first junction and the second junction.

30. A method of manufacturing a resistor, comprising:

joining a first end of a body to a first termination forming a first junction having a length and joining a second end of the body to a second termination forming a second junction having the same length, wherein the body includes at least one resistive element;

wherein the resistive element, the first termination, and the second termination are arranged to have a temperature gradient along the length of each junction, mitigating thermally induced voltages between the first junction and the second junction.

* * * * *